US008147092B2

(12) United States Patent
Wu et al.

(10) Patent No.: US 8,147,092 B2
(45) Date of Patent: Apr. 3, 2012

(54) ILLUMINATING DEVICE

(75) Inventors: Meng-Chai Wu, Hsin-Chu Hsein (TW); Chien-Lung Lee, Hsin-Chu Hsein (TW)

(73) Assignee: Lextar Electronics Corp., Hsinchu (TW)

( * ) Notice: Subject to any disclaimer, the term of this patent is extended or adjusted under 35 U.S.C. 154(b) by 161 days.

(21) Appl. No.: 12/076,436

(22) Filed: Mar. 18, 2008

(65) Prior Publication Data

US 2010/0188836 A1 Jul. 29, 2010

(30) Foreign Application Priority Data

Feb. 5, 2008 (TW) ..... 97104628 A

(51) Int. Cl.
*F21V 9/00* (2006.01)

(52) U.S. Cl. ..... 362/231; 362/84; 362/293

(58) Field of Classification Search ..... 362/84, 362/231, 235, 249.02, 612, 613, 614, 293
See application file for complete search history.

(56) References Cited

U.S. PATENT DOCUMENTS 5,502,626 A * 3/1996 Armstrong et al. ..... 362/216
7,821,023 B2 * 10/2010 Yuan et al. ..... 257/98

* cited by examiner

*Primary Examiner* — John A Ward
(74) *Attorney, Agent, or Firm* — Liu & Liu

(57) ABSTRACT

An illuminating device comprises a base, a light source and at least one first layer, wherein said light source is assembled on said base to emit a first color temperature light, while first layer is located on the base along the first light irradiation path. The first light is passed through the first layer to react with said first layer to form a second color temperature light for emission, wherein said first color temperature is ranged from 2800K to 20000K, while excitation wavelength range of said first layer is mainly beyond the wavelength of ultraviolet lights for further adjusting the second color temperature range.

24 Claims, 7 Drawing Sheets

ILLUMINATING DEVICE

BACKGROUND OF THE INVENTION (a) Field of the Invention

The invention is related to an illuminating device design, more particularly to a light emitting diode (LED) illuminating device whose color temperature can be optionally adjusted as needed.

(b) Description of the Prior Art:

Articles illuminated by a natural light source or an artificial light source shall have enough lightness to appear coloring for human eyes to feel it, while when light disappears, coloring is also disappeared. The light, similar to colors, has a degree of warmth in psychological feeling to human beings. Therefore, light can be described by color temperatures and color can be represented by color coordinate, wherein both of them are very similar to each other. Hence, light colors can be flexibly manipulated to form a favorable environment atmosphere thereby to satisfy different needs of scenarios, such as that the warm and soft atmosphere and feeling of softness for indoor woods, cloths and carpets can be enhanced by low color temperature lights. In hot area, an atmosphere of coolness and serenity can be made by high temperature color lights. Color temperature is defined to be expressed in absolute temperatures K, i.e. a standard black body is heated up to a certain temperature, from where its color is gradually changed from dark red, light red, orange, white, blue till the same color of light source, then the absolute temperature of said black body at that moment is the color temperature of said light source, whereas for different light source color temperature, the light color is also different. The light with a color temperature at 3000K appearing in warm color letting people feel relaxed and comfortable is suitable for residences or hotels . The light with a color temperature between 4000-5000K appearing in soft white color is suitable for offices or schools. The light with a color temperature at 6000K appearing in a cool daylight color is suitable for printing, textile or dyeing and finishing industries. However, color temperature cannot be changed by conventional illuminating devices which are unable to flexibly produce different color temperatures corresponding to different demands, therefore one of the two methods of prior art for color temperature adjustment is by letting the light of usually a white color light pass through color filters to produce different color temperatures, such as U.S. Pat. No. 6,755,555 B2, publicized on Jun. 29$^{th}$, 2004 has disclosed a "Auxiliary illuminating device having an adjustable color temperature by controlling the amount of light passing through color filters", wherein the portions including color filters of different colors and quantities are placed in front of a light source to change color temperatures of said light source according to required color temperatures.

Nevertheless, the different color lights produced by passing color filters as described in aforesaid method shall be further mixed by a good light mixing device, or only color lights instead of color temperature changes are formed. Further, as multiple color filters are required by said method, the volume and weight of the illuminating device are increased. Furthermore, said method also causes unnecessary loss of light strength.

Another method is to install more than two light sources in different colors in the illuminating device, whereby the lights are mixed to produce lights at different color temperatures, such as U.S. Pat. No. 6,379,022 B1, publicized on Apr. 30$^{th}$, 2002 has disclosed an "Auxiliary illuminating device having adjustable color temperature", wherein the light source of said art is a light source arrays with at least two colors, and at least one light emitting diode (LED) is typically utilized for color temperature adjustment purpose. Said method is obviously disadvantageous to require more than two kinds of lights at different colors, and that causes not only the volume of illuminating device but also the cost to increase. Further, requirement for additional circuits for control also causes manufacturing cost to increase.

SUMMARY OF THE INVENTION

In view of this, the invention discloses an innovative illuminating device for adjusting the color temperature whereof.

The illuminating device in the embodiment of the invention includes a base, a light source and at least one first layer, wherein said light source is assembled on the base to emit a first color temperature light, at least one first layer is located above the base along a first light irradiation path, and said first layer can be combined with a phosphor layer. Thereby, when first light is passed through said first layer to react with said first layer to form a second color temperature light for emission, wherein said first color temperature is ranged from 2800K to 20000K, while excitation wavelength range of said first layer is mainly beyond the wavelength of ultraviolet lights for adjusting the second color. temperature range.

One purpose of the invention is to disclose an illuminating device which includes at least one first layer to change the designated color temperature of the light source, wherein the better color temperature of illuminating device is above 2800K to 7000K.

DETAIL DESCRIPTION OF THE PREFERRED EMBODIMENTS

Figure 1:
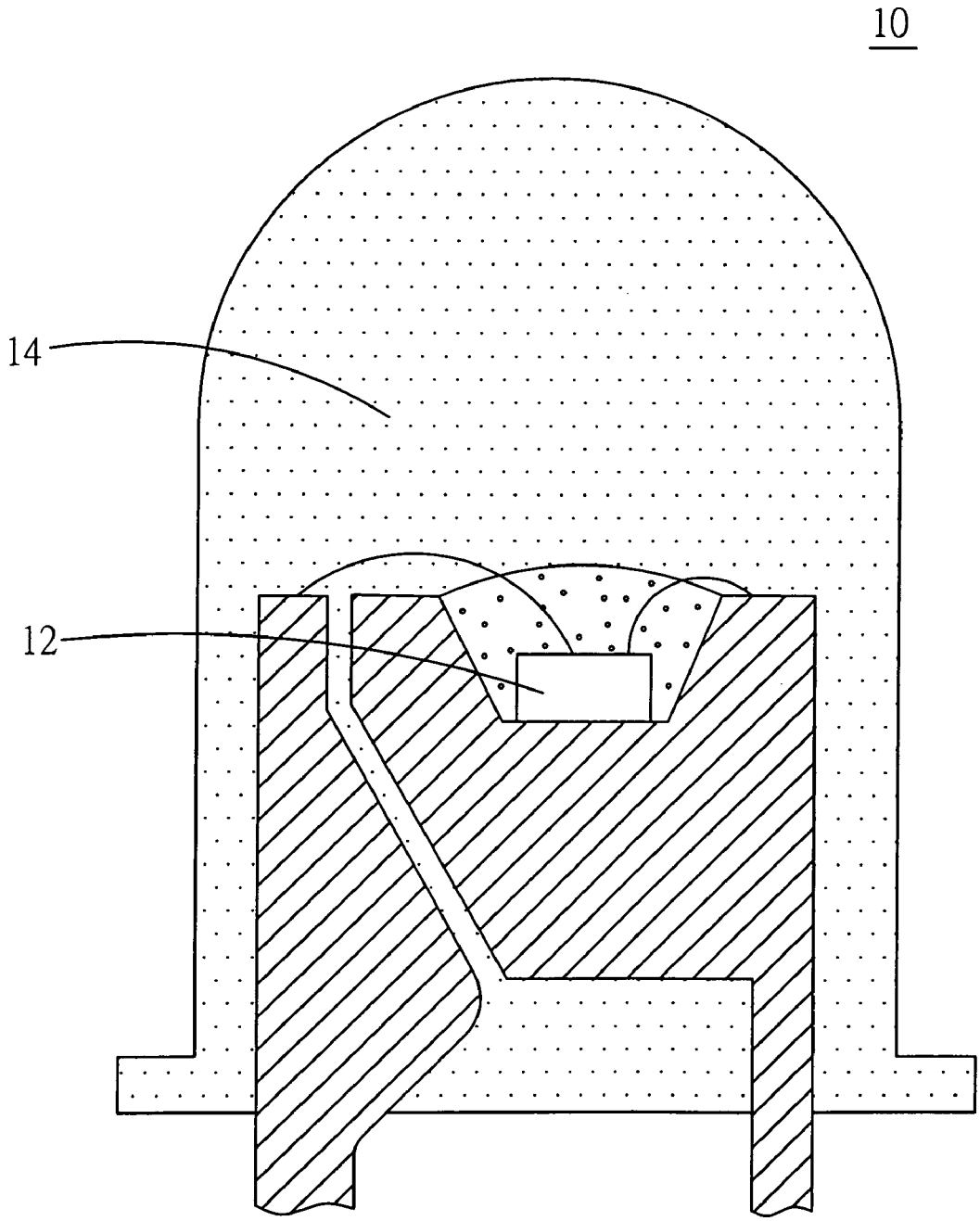
FIG.1 PRIOR ART
FIG. 1 is a cross-sectional view of a known illuminating component.
Figure 2:
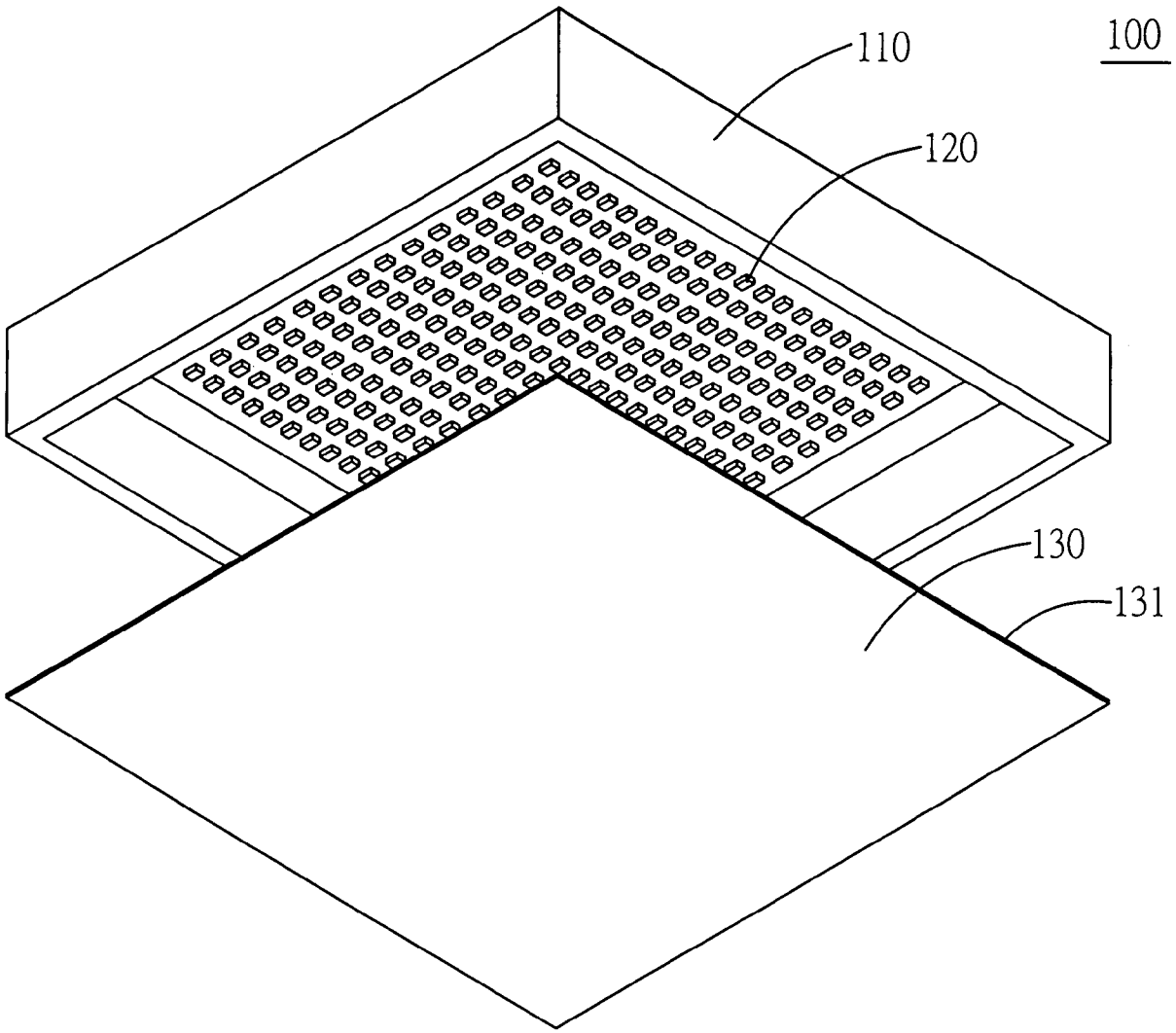
FIG. 2 is a decomposition view showing a preferred embodiment of the invented illuminating device.
Figure 3:
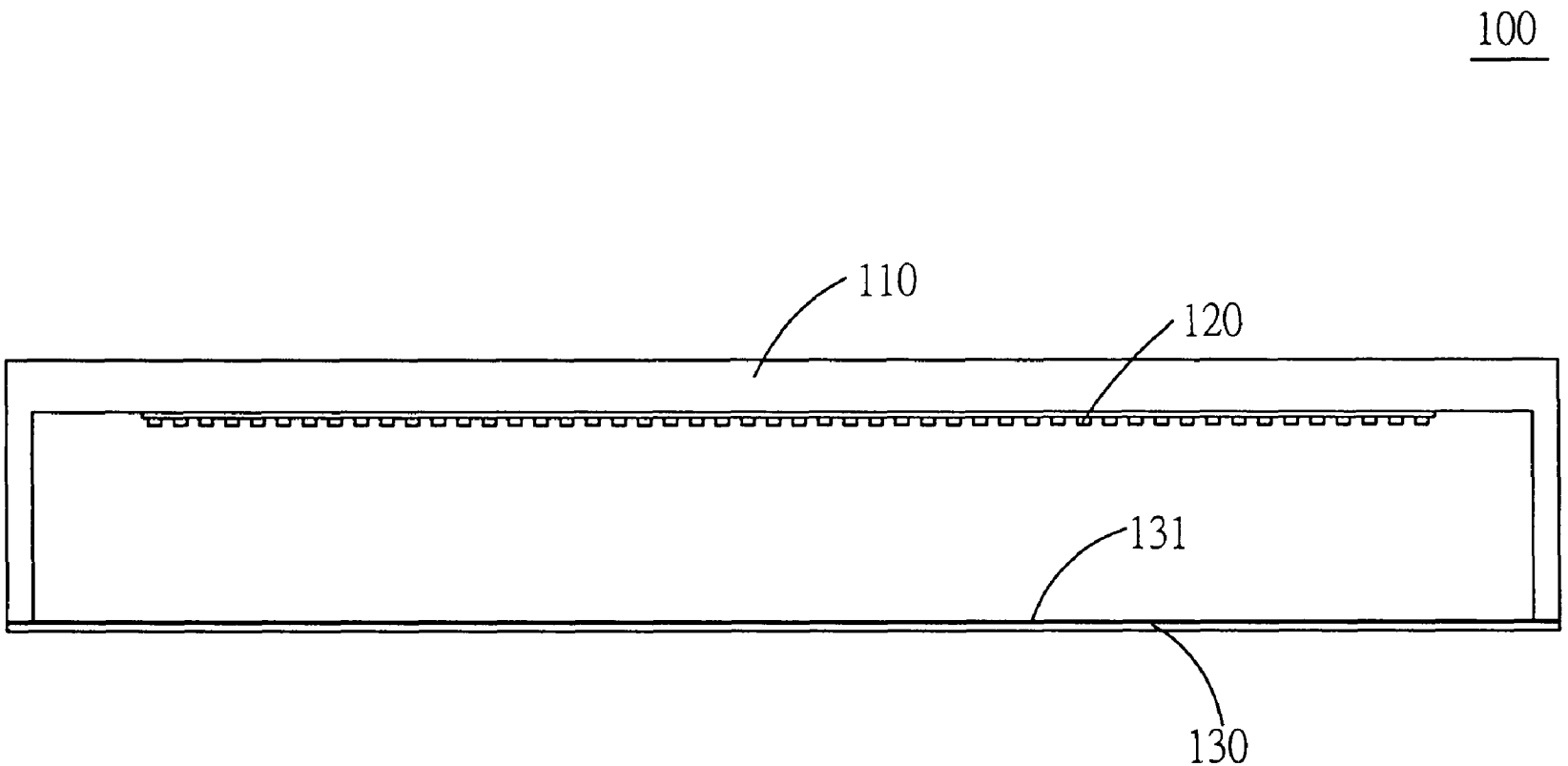
FIG. 3 is a cross-sectional view showing a preferred embodiment of the invented illuminating device.
Figure 4:
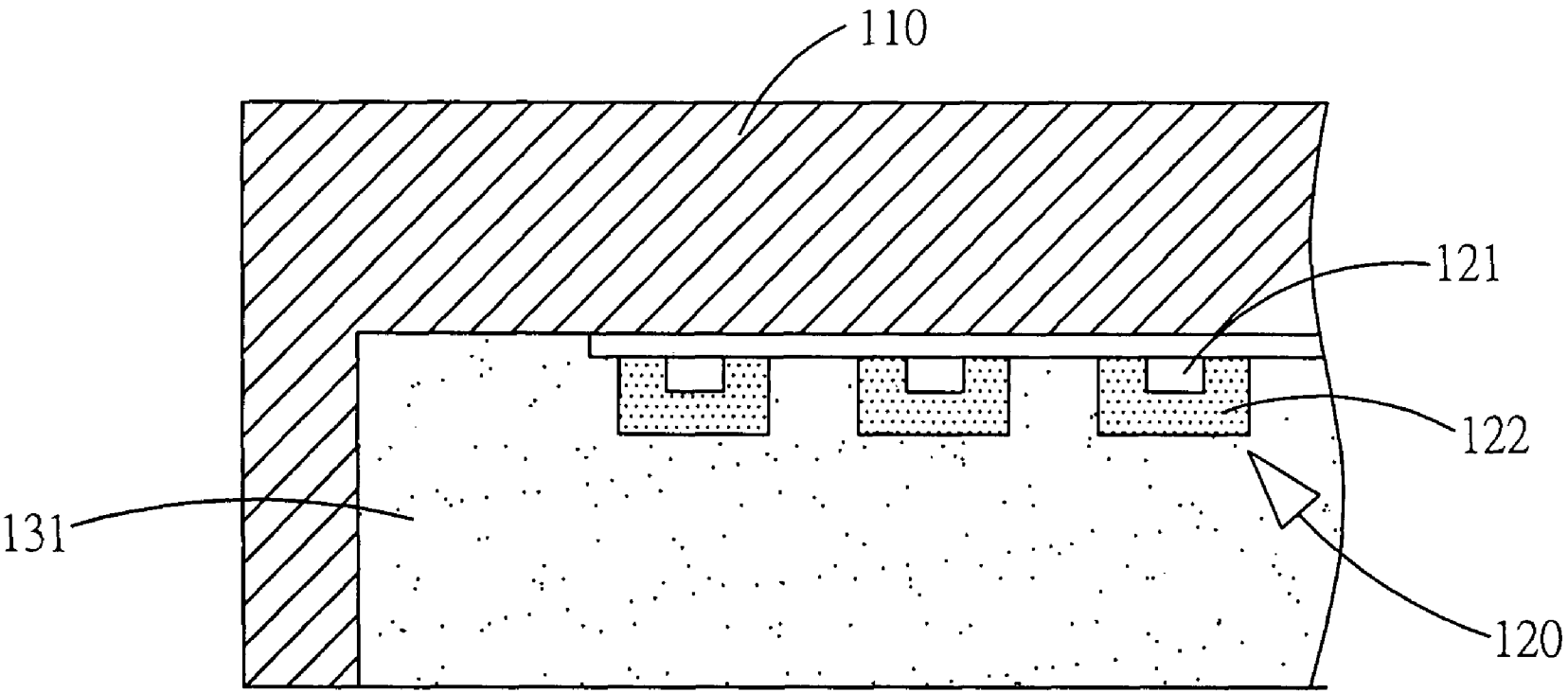
FIG. 4 is a cross-sectional view of another preferred embodiment of the invented illuminating device.

Referring to FIGS. 2 and 3, FIG. 2 is a structure profile showing a preferred embodiment of the invented illuminating device. FIG. 3 is a cross-sectional view showing a preferred embodiment of the invented illuminating device. As shown in the Figure, said illuminating device 100 comprises a base 110, a light source 120 and at least one first layer 131, wherein light source 120 is assembled on base 110 to illuminate a first color temperature light. As in the embodiment shown by the Figure, said illuminating device 100 is made with a first layer 131 at the inside surface of a light guiding component 130 (of course, it can also be made at the outside surface of said light guiding component) , while said first layer 131 can be coated by a phosphor layer thereon, wherein said light guiding component 130 is installed on base 110 along the first light irradiation path, whereby, the first color temperature light emitted from light source 120 is passed through light guiding component 130 to react with first layer 131 to form a second color temperature light emitted through said light guiding component 130, wherein said first color temperature is ranged between 2800K to 20000, while the excitation wavelength range of said first layer 131 is mainly beyond the wavelength of ultraviolet lights. Further, said first layer is constituted by phosphor s selected from or any combination of the following:

$Y_{3+t+u}Al_{5+u+2v}O_{12+2t+3u+3v}$: $Ce^{3}$+
wherein 0<t<5, 0<u<15, 0<v<9;

$Y_{3+t+u}Al_{5+u+2v}O_{12+2t+3u+3v}$: $Ce^{+}$, Tb
wherein 0<t<5, 0<u<15, 0<v<9;

$Y_{3+t+u}Mo_mW_nA_{15+u+2v}O_{12+2t+3u+3v+3m+3n}$:$Ce^{3+}$
wherein 0<t<5, 0<u<15, 0<v<9, 0<m<20, 0<n<20;

$(Y_{1-p-q-r}Gd_pCe_qSmr)_3$ $(Al_{1-s}Ga_s)_5O_{12}$: $Ce^{3+}$
wherein 0≦p≦0.8, 0.003≦q≦0.2, 0.0003≦r≦0.08, 0≦s≦1;

$(Tb, Y, Gd, La, Lu, Ce)_3$ $(Al, Ga)_5O_{12}$: $Ce^{3+}$;

$(Y, Ca, Sr)_3$ $(Al, Ga, Si)_5$ $(O/S)_{12}$: $(Ce, Tb)^{3+}$;

$Y(Al\ or\ Ga)_5O_{12}$: $(Ce\ or\ Tb)^{3+}$;

$Ca_{8-x-y}Eu_xMn_yMg(SiO_4)_4$, wherein x: 0.005~1.6, y: 0~1;

$(Tb_{1-x-y}RE_xCe_y)_3$ $(Al, Ga)_5O_{12}$: Ce, wherein RE=Y, Gd, La and/or Lu, 0<x<0.5-y, 0<y<0.1 ;

In the embodiment, said light source 120 comprises a light emitting diode (LED) for the example, while said light source 120 can also comprise fluorescent lamps in other embodiments. The first light emitted from said light source is a white light whose first color temperature is ranged between 2800K to 20000K, and said light source 120 naturally can further include an illuminating component 121 and a second layer 122. As shown in FIG. 4, the light emitted by said illuminating component 121 is passed through second layer 122 to form a first light in white color with the first color temperature ranging from 2800K to 20000K, wherein said illuminating component 121 can be a light emitting diode (in green light, blue light or red light) , while said second layer 122 is a phosphor layer and said first layer 131 can be sealed above each light source 120, thereby to allow first light to react with first layer 131 to from a second color temperature light for emission.

The light source in other embodiments can be made to mix into a white color light by other methods such as using yellow phosphor s to match with blue light emitting diodes, or using green phosphor s and yellow phosphor s to match with blue light emitting diodes, or using white light emitting diode directly.

Figure 5:
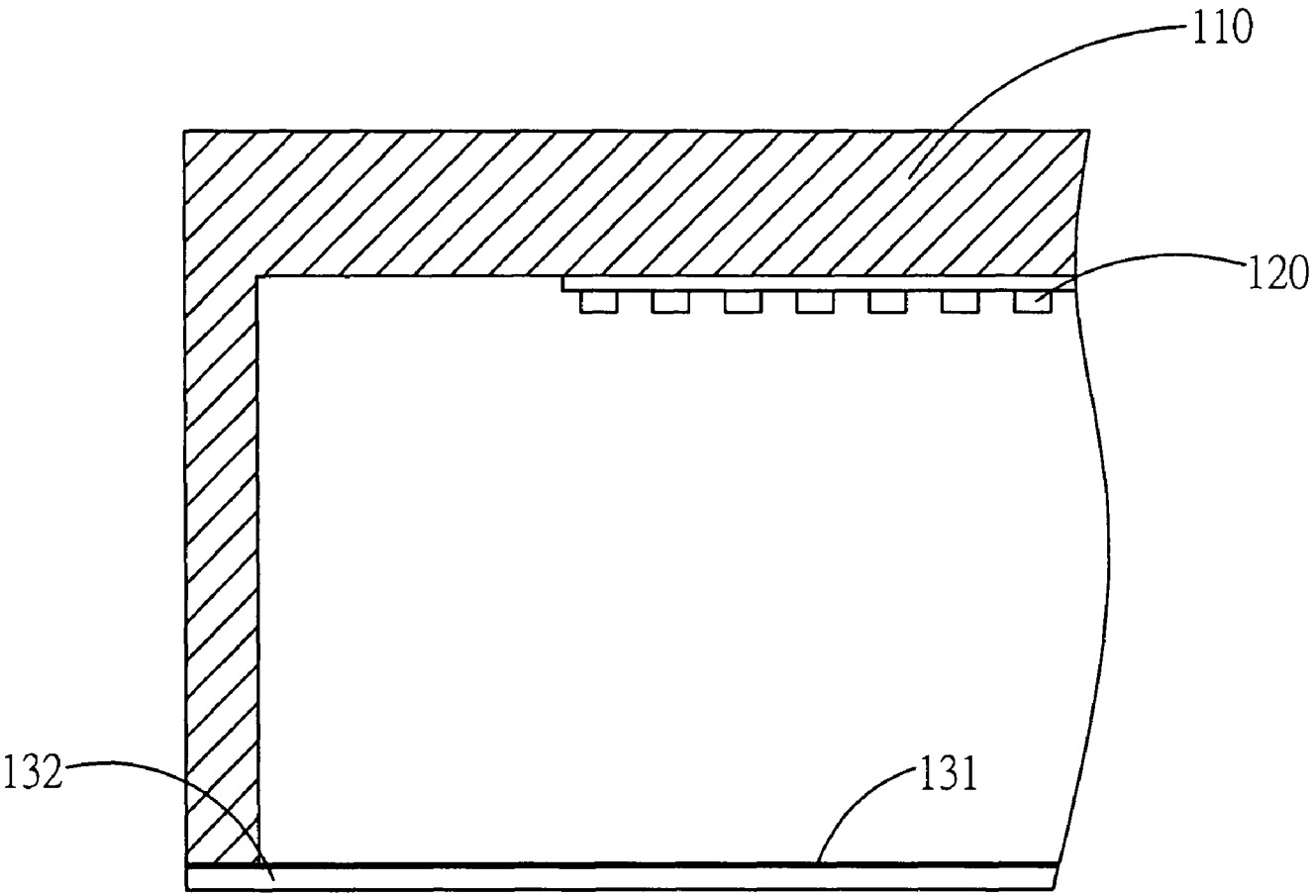
FIG. 5 is a schematic view showing the first embodiment of the light guiding component of the invention.
Figure 6:
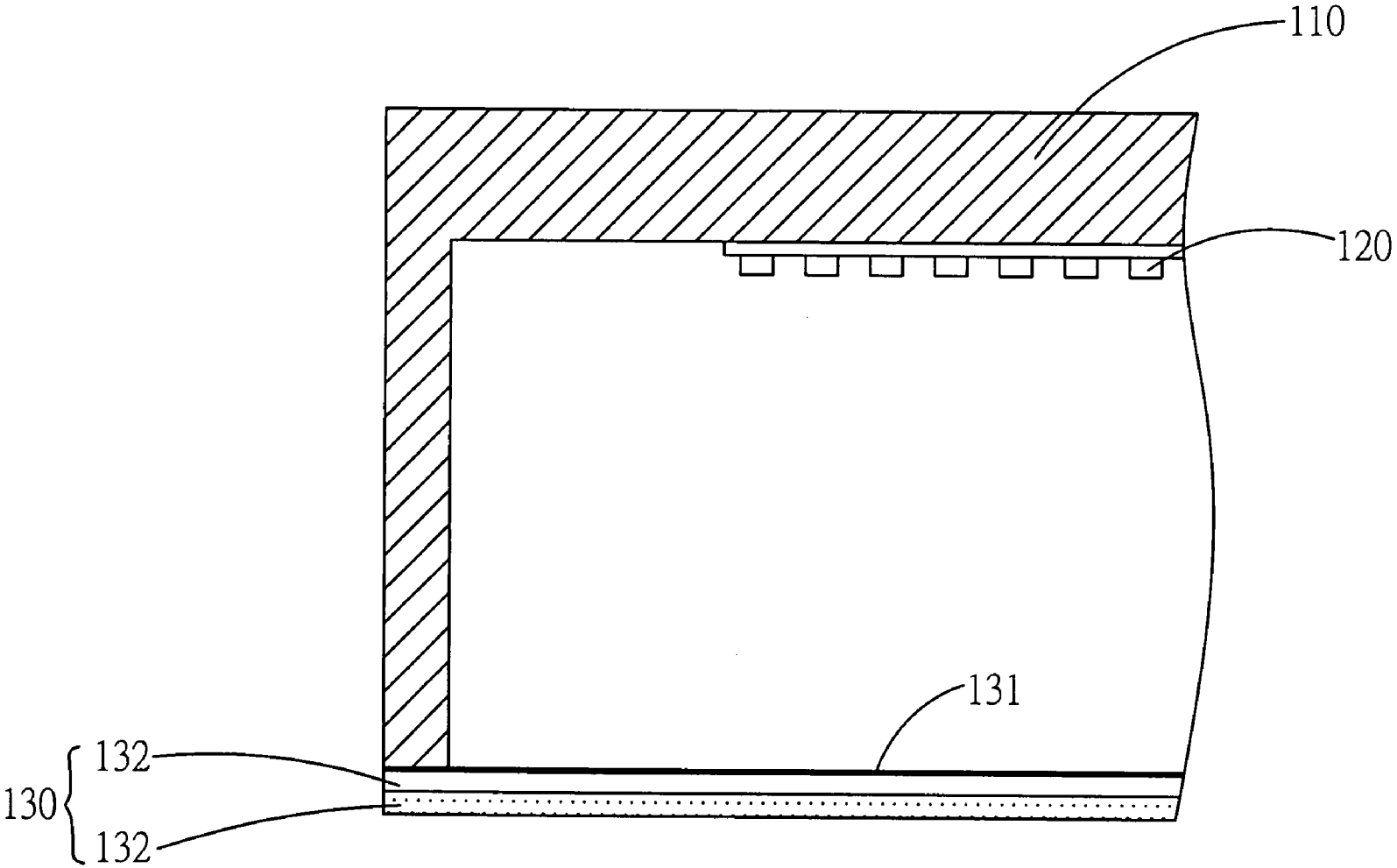
FIG. 6 is a schematic view showing the second embodiment of the light guiding component of the invention.

For example, the light guiding component 130 can be constituted by an optical lens 132, wherein as shown by FIG. 5 which is a schematic view showing the first embodiment of the light guiding component of the invention, the light guiding component can be a layer of optical lens 132, and as shown by FIG. 6 which is a schematic view showing the second embodiment of the light guiding component of the invention, the light guiding component 130 is constituted by multiple layers of optical lenses 132, wherein the light guiding component 130 is made of any material of glass, plastic and thin film, etc.

Figure 7:
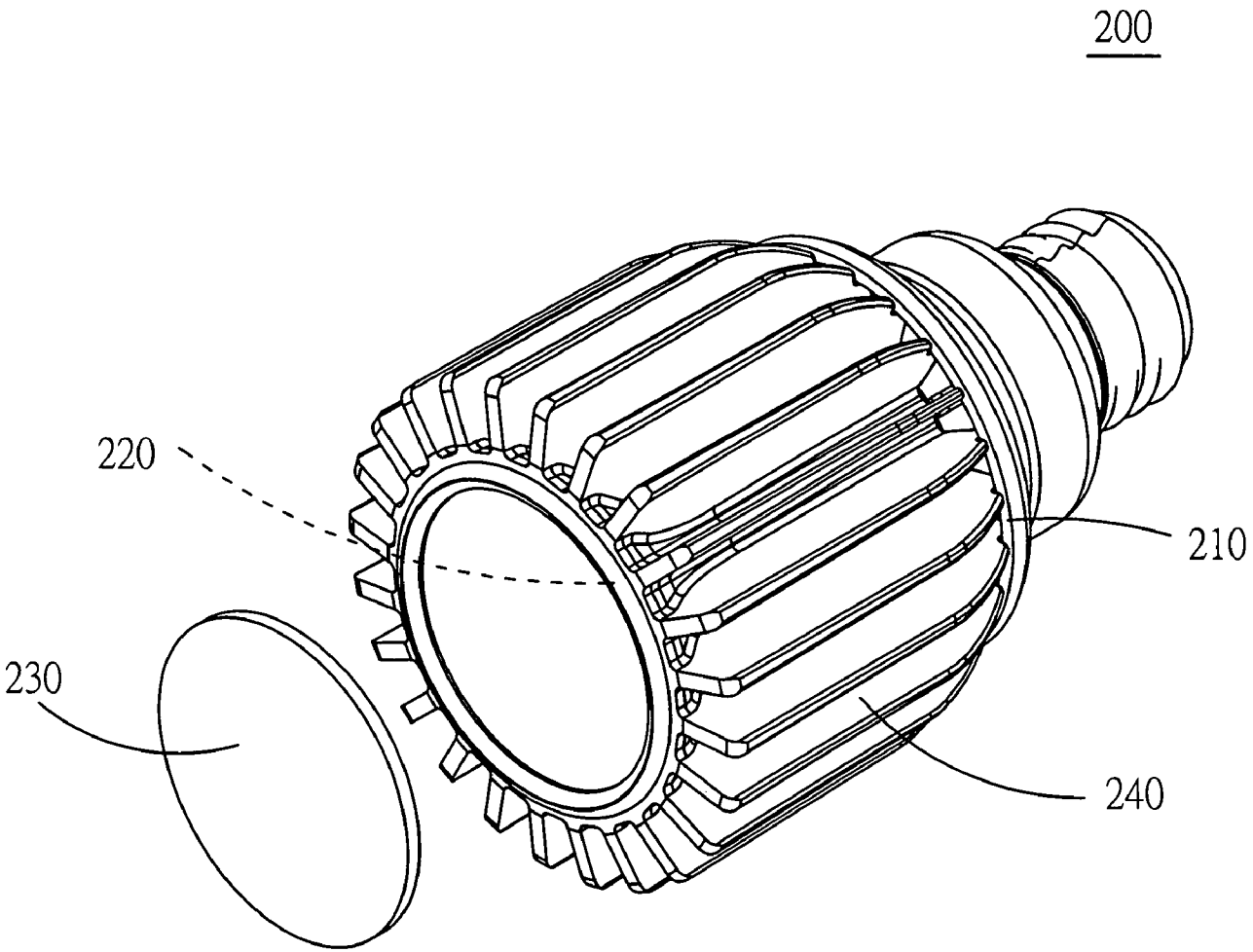
FIG. 7 is a schematic view of another preferred embodiment of the invented illuminating device.

FIG. 7 is a schematic view of another preferred embodiment of the invented illuminating device, wherein another embodiment of the invention can be used to more clearly describe the illuminating device of the invention. As shown in the Fig., the illuminating device 200 comprises a base 210, a light source 220 and a light guiding component 230, wherein said light source 220 is assembled above the base 210 to emit a first color temperature light, and said light guiding component 230 is installed on base 210 along the first light irradiation path, while said light guiding component 230 further include a phosphor layer. Through this, the first color temperature light emitted by the light source 220 is passed through the light guiding component 230 to react with the phosphor layer to form a second color temperature light for emission through said light guiding component 130. Further, said illuminating device 200 additionally comprises heat dissipating components 240 to be installed at the peripheral edge of base 210 to accelerate the heat dissipating efficiency of base 210, wherein the heat dissipating component 240 such as heat dissipating fins can be made of metal materials.

For said reason, the illuminating device disclosed by the invention can be through at least one layer (can be combined with a phosphor layer) to simply change the designated color temperature of the light source, hence, said illuminating device is most importantly characterized to easily change the color temperature. Therefore, the invention is full of originality and progressiveness to meet the requirements for patent applications. Hence, it is herein applied according to law and your earlier approval on the claims is greatly appreciated.

The invention has been specifically described hereinbefore, wherein only preferred embodiments of the invention are described, and scope of the invention shall not be limited thereto. All equivalent changes or modifications thereof relative to claims of the invention shall be included in the claimed scope of the invention.

We claim:

1. An illuminating device comprising:

a base;

a light source assembled on said base to emit a first light with a first color temperature ranging from 2800K to 20000K; and a first layer located above said base and said light source along a first light irradiation path, said first layer receiving the first light having the first color temperature, wherein a second light with a second color temperature that is different from the first color temperature and ranges from 2800K to 7000K is produced when said first light passes through said first layer to react with said first layer, thereby producing the second light with the second color temperature, wherein the light source comprises a plurality of discrete illuminating components, each covered by a separate second layer, and wherein the light emitted by each illuminating component passes through the corresponding second layer to form the first light.

2. The illuminating device as claimed in claim 1, wherein said illuminating component comprises light emitting diodes (LED).

3. The illuminating device as claimed in claim 1, wherein said second layer can be a phosphor layer.

4. The illuminating device as claimed in claim 1, wherein said first light is a white color light.

5. The illuminating device as claimed in claim 1, wherein said light source can be a fluorescent light.

6. The illuminating device as claimed in claim 1, wherein said light source can be constituted by white color light emitting diodes.

7. The illuminating device as claimed in claim 1, wherein said base is further made with a light guiding component with said first layer installed thereon.

8. The illuminating device as claimed in claim 7, wherein said first layer is made at the inside surface or outside surface of said light guiding component.

9. The illuminating device as in claim 8, wherein said first layer is coated on said light guiding component.

10. The illuminating device as claimed in claim 7, wherein said first layer is made inside said light guiding component.

11. The illuminating device as claimed in claim 7, wherein said light guiding component includes an optical lens.

12. The illuminating device as claimed in claim 7, wherein said light guiding component includes a plurality of optical lenses.

13. The illuminating device as claimed in claim 7, wherein said light guiding component comprises anyone of glass, plastic or thin film.

14. The illuminating device as claimed in claim 1, which further includes a heat dissipating component to be installed at the peripheral edges of said base.

15. The illuminating device as claimed in claim 14, wherein said heat dissipating component includes a heat dissipating fin.

16. The illuminating device as claimed in claim 1, wherein said first layer can be constituted by phosphor s selected from or any combination of the following:

a. $Y_{3+t+u}Al_{5+u+2v}O_{12+2t+3u+3v}:Ce^{3+}$
wherein $0<t<5$, $0<u<15$, $0<v<9$;

b. $Y_{3+t+u}A_{l5+u+2v}O_{12+2t+3u+3v}:Ce^{+}$, Tb
wherein $0<t<5$, $0<u<15$, $0<v<9$;

c. $Y_{3+t+u}Mo_mW_nA_{15+u+2v}O_{12+2t+3u+3v+3m+3n}:Ce^{3+}$
wherein $0<t<5$, $0<u<15$, $0<v<9$, $0<m<20$, $0<n<20$;

d. $(Y_{l-p-q-r}Gd_pCe_qSmr)_3(Al_{l-s}Ga_s)_5O_{12}:Ce^{3+}$,
wherein $0\leqq p\leqq 0.8$, $0.003\leqq q\leqq 0.2$, $0.0003\leqq r\leqq 0.08$, $0\leqq s\leqq 1$;

e. $(Tb, Y, Gd, La, Lu, Ce)_3(Al, Ga)_5O_{12}:Ce^{3+}$;

f. $(Y, Ca, Sr)_3(Al, Ga, Si)_5(O, S)_{12}:(Ce, Tb)^{3+}$;

g. $Y(Al \text{ or } Ga)_5O_{12}$: $(Ce \text{ or } Tb)^{3+}$;

h. $Ca_{8-x-y}Eu_xMn_yMg(SiO_4)_4$, wherein x:0.005~1.6,y:0~1;

i. $Tb_{l-x-y}RE_xCe_y)_3(Al, Ga)_5O_{12}:Ce$, wherein RE=Y, Gd, La and/or Lu, $0<x<0.5-y$, $0<y<0.1$.

17. The illuminating device as claimed in claim 1, wherein said first layer is a phosphor layer.

18. The illuminating device as claimed in claim 1, wherein the light source comprises a plurality of light emitting diodes, each emitting light of same color as the first light.

19. The illuminating device as claimed in claim 1, wherein the first layer encapsulates the illuminating components and fills the spaces between the second layers of adjacent illuminating components.

20. An illuminating device comprising:

a base;

a light source supported on said base, emitting a first light with a first color temperature ranging from 2800K to 20000K;

a light guiding component supported by the base, extending over said light source along a light irradiation path, wherein a space is defined between said light guiding component and said light source;

a first layer supported on a surface of the light guiding component, said light guiding component and said first layer receiving the first light having the first color temperature, wherein a second light with a second color temperature that is different from the first color temperature of the first light and ranges from 2800K to 7000K is produced when said first light passes through said first layer to react with said first layer, thereby producing the second light with the second color temperature.

21. The illuminating device as claimed in claim 20, wherein said light source comprises an illuminating component and a second layer, and the light emitted by said illuminating component passes through said second layer to form the first light.

22. The illuminating device as claimed in claim 21, wherein the light source comprising a plurality of discrete illuminating components, each covered by a separate second layer, and wherein the light emitted by each illuminating component passes through the corresponding second layer to form the first light.

23. The illuminating device as claimed in claim 20, wherein the light guiding component is planar, wherein the light source comprises a plurality of illuminating components extending over a plane parallel to the planar light guiding component, and wherein the light guiding component extends over the light source to define the space therebetween.

24. The illuminating device as claimed in claim 23, wherein the planar light guiding component comprises at least an optical lens.

* * * * *